United States Patent [19]

Beck et al.

[11] 4,120,235

[45] Oct. 17, 1978

[54] APPARATUS FOR TRANSVERSELY SEALING A WRAPPING TUBE

[75] Inventors: Otto Beck, Stuttgart-Heumaden; Klaus Hamm, Stuttgart, both of Fed. Rep. of Germany

[73] Assignee: Robert Bosch GmbH, Stuttgart, Fed. Rep. of Germany

[21] Appl. No.: 783,662

[22] Filed: Apr. 1, 1977

[30] Foreign Application Priority Data

Apr. 7, 1976 [DE] Fed. Rep. of Germany ..... 2614990

[51] Int. Cl.[2] ..... B31B 1/64

[52] U.S. Cl. ..... 93/33 H; 74/54; 74/63; 156/515

[58] Field of Search ..... 93/33 H, DIG. 1, 8 R; 156/515, 583; 53/182 R; 74/54, 63, 805

[56] References Cited

U.S. PATENT DOCUMENTS

| | | | |
|---|---|---|---|
| 2,275,976 | 3/1942 | Mead | 93/DIG. 1 |
| 2,467,879 | 4/1949 | Billeb | 93/DIG. 1 |
| 2,470,766 | 5/1949 | Durning | 74/54 UX |
| 3,522,689 | 8/1970 | Wylie et al. | 93/33 H UX |
| 3,740,300 | 6/1973 | Heinzer | 156/583 |
| 3,850,780 | 11/1974 | Crawford et al. | 53/182 R X |
| 4,023,470 | 5/1977 | Van Der Meulen | 93/33 H X |

FOREIGN PATENT DOCUMENTS

| | | |
|---|---|---|
| 840,036 | 4/1952 | Fed. Rep. of Germany. |
| 1,511,728 | 7/1969 | Fed. Rep. of Germany. |

*Primary Examiner*—James F. Coan
*Attorney, Agent, or Firm*—Edward E. Sachs

[57] ABSTRACT

Apparatus for transversely sealing a wrapping tube includes opposed sealing tools movable in unison linearly along an operating path having a beginning and an end while sealing a wrapping tube. The tools return from the end of the operating path to the beginning thereof by moving along arcuate return paths. Crank mechanisms for so moving the tools include cam tracks and cooperating cam followers. The cam followers are urged against the cam tracks under the influence of centrifugal force during movement of the tools along the return paths.

11 Claims, 3 Drawing Figures

APPARATUS FOR TRANSVERSELY SEALING A WRAPPING TUBE

The invention relates generally to crank mechanisms and, more particularly, to crank mechanisms for moving a tool along a linear operating path having a beginning and an end, and then returning the tool from the end to the beginning by moving same along a return path separate from the operating path. The invention is particularly applicable for use in an apparatus for transversely sealing a wrapping tube and will be particularly described with respect thereto. However, it will be appreciated that the invention has broader aspects and the crank mechanism in particular may be used for other purposes.

A known type of continuously operating wrapping machine includes a linearly moving wrapping tube. Apparatus is provided for transversely sealing and, if desired, severing the wrapping tube. This apparatus includes tools which move linearly with the wrapping tube along a linear operating path having a beginning and an end, and returning from the end to the beginning by moving along curved paths independent of the operating path.

One apparatus of the type described is disclosed in German Pat. No. 1,270,478. An apparatus of the type disclosed in this patent includes tools carried by tool carriers arranged in pairs and driven by parallel crank mechanisms. The lengths of the cranks are simultaneously adjustable, and the crank mechanisms have crank discs in the form of gear wheels. The crank mechanisms also include crank pins carrying levers upon which the tool carriers are mounted.

In the apparatus of the type disclosed in the German patent, the effective lengths of the cranks are varied by means of stationary cams cooperating with cam followers. The cam followers are in the form of rollers mounted upon roller axles secured to the levers mounted on the crank pins. Springs act upon the levers in a manner for pressing the rollers against the cams. As the crank disc gear wheels rotate, the cams cooperate with the cam followers defined by the rollers to deflect the levers outwardly in such a manner that the tools travel along the desired operating path linearly and then along the return paths.

In an attempt to increase the speed and output of an apparatus of the type described, it has been found that it is necessary to make the springs acting on the levers very powerful in order to prevent the rollers from lifting off the cams and allowing the tools to move randomly. Compression of the more powerful springs requires considerably more energy for driving the crank mechanisms as the rollers travel along the ascending sides of the cam lobes. Furthermore, the rollers acting upon the cranks cause the crank mechanisms to overrun the drive as the rollers travel along the descending sides of the cam lobes. If there is any slack in the drive, the result of overrunning creates backlash, noise and premature wear.

It would be desirable to have an apparatus of the type described wherein the disadvantages pointed out could be overcome with a minimum of technical complexity.

It is therefore the primary object of the present invention to provide an apparatus for transversely sealing a wrapping tube in a very reliable but simple manner.

It is another object of the invention to provide an improved crank mechanism for moving sealing tools in such a manner that powerful springs are not required for holding cam followers against a cam surface.

It is an additional object of the invention to provide an apparatus of the type described with improved crank mechanisms arranged very compactly and wherein cam followers are urged into engagement with cam surfaces under the influence of centrifugal force.

An aspect of the invention resides in improvements on the type of mechanism previously described wherein opposed sealing tools travel with the wrapping tube along a substantially linear operating path having a beginning and an end, and returning from the end to the beginning along curved return paths separate from the operating path. Upper and lower crank mechanisms guide and move the tools along their paths and the lengths of the cranks are adjustable by means of stationary cams. The crank mechanisms include crank pins rotating about crank shafts, and levers are mounted on the crank pins for moving the tools which are positioned in carriers on the levers. Cam followers cooperating with the cams include rollers mounted rotatably on roller axles secured to the levers.

In accordance with the invention, the crank mechanisms are designed in such a manner that movement of the tool carriers along their return paths causes the cam followers to be urged against cam surfaces under the influence of centrifugal force acting on the levers. In addition, the movement of the tool carriers is positively guided by cam tracks in such a manner that unwanted deviations from the desired movement path is impossible.

In accordance with one aspect of the invention, the cam tracks cooperating with the cam followers are defined by spaced-apart opposed outer and inner cam surfaces between which the cam followers are positioned. The inner and outer cam surfaces effectively define a double cam enclosing the cam follower associated therewith. These improvements eliminate the need for springs to press the tool carriers against each other as they move along the linear operating path, and the guiding forces between the cam tracks and cam followers oppose centrifugal forces acting on the levers to urge the cam followers against the cam surfaces. As a result, the apparatus operates very quietly with a minimum of wear, and is less expensive to drive.

In accordance with another aspect of the invention, at least certain of the levers are in the form of eccentrics mounted in surrounding relationship to the crank pins. Openings are provided in the eccentrics of two equiaxial crank mechanisms for receiving a common drive shaft for the mechanisms. This arrangement provides very stable crank mechanisms and makes it possible to use a very inexpensive drive connection between equiaxially arranged crank mechanisms.

The sealing tools used in the apparatus may take many forms depending upon the type of packaging material from which the wrapping tube is formed. The sealing tools may perform transverse welding, or welding and severing operations.

Considerable economy and simplicity in the apparatus is achieved by using only two pairs of crank mechanisms instead of four as used in German Pat. No. 1,270,478. Alignment of the tool carriers in their movements along the paths is accomplished by the use of guide means in the form of elongated guide rods secured to one tool carrier and passing in closely guided relationship through holes in the other carrier. The guide means is generally of the type disclosed in U.S.

Pat. No. 3,740,300 issued June 19, 1973, to Heinzer. However, in contrast to the apparatus disclosed in the Heinzer patent, the apparatus of the present application has the cranks rotating about fixed axes so that special drive means is not required to cope with varying distances between crank axes.

In accordance with another aspect of the invention, crank disc gear wheels in upper and lower crank mechanisms are drivingly engaged with one another. Crank pins on which the levers are mounted are carried by the crank discs and the lower crank discs are drivingly connected by a drive shaft passing through openings in the lever eccentrics mounted on the crank pins in the lower mechanisms. This arrangement greatly simplifies the technical nature of the apparatus.

For a better understanding of the present invention, together with other and further objects thereof, reference is had to the following description taken in connection with the accompanying drawings, and its scope will be pointed out in the appended claims.

Figure 1:
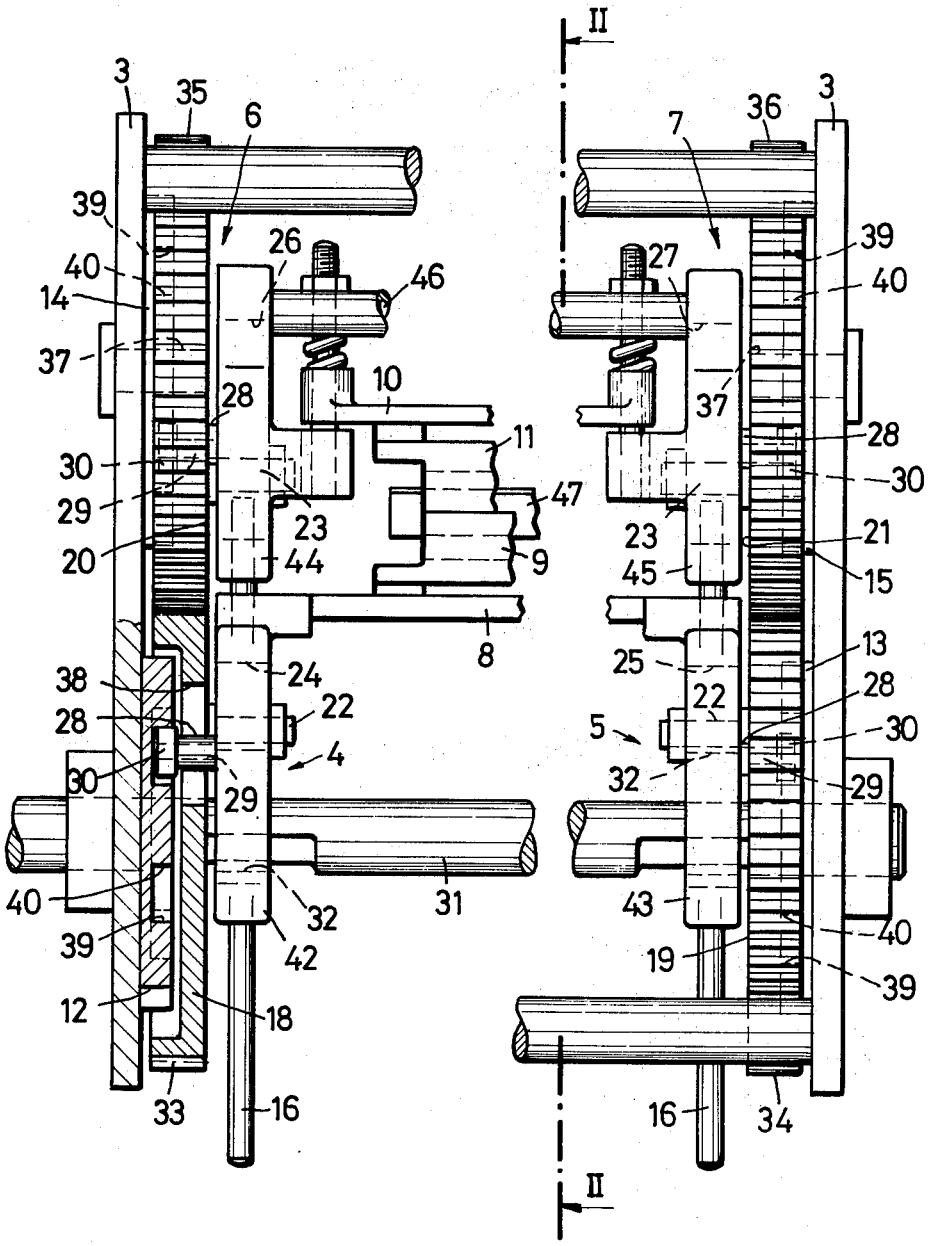
FIG. 1 is a front elevational view of an apparatus constructed in accordance with the present invention.

Referring now to the drawing, there is shown an apparatus including a support frame 3 for a pair of lower crank mechanisms 4 and 5, a pair of upper crank mechanisms 6 and 7, a lower tool carrier 8 for a lower sealing tool 9 and an upper tool carrier 10 for an upper sealing tool 11. Mounted to the frame 3 are stationary lower cams 12 and 13, and upper cams 14 and 15. Linear guide means for the tool carriers 8 and 10 takes the form of elongated guide rods 16 and eyes 17 on the tool carrier 8.

The crank mechanisms 4, 5, 6 and 7 include crank disc gear wheels 18, 19, 20, and 21 rotatably mounted adjacent the cams 12, 13, 14 and 15. Opposite crank pins 22 on the crank discs 18 and 19 extend toward one another on one side of these crank discs. Crank pins 23 extend toward one another from one side of the crank discs 20 and 21. The crank pins 22 have levers in the form of eccentrics 24 and 25 mounted thereon, while the crank pins 23 have levers in the form of eccentrics 26 and 27 mounted thereon. The levers or eccentrics carry arms 28 and have cam followers mounted thereon in the form of rollers 30 mounted rotatably on axles 29 secured to the levers 24–27.

The lower crank discs 18 and 19 are drivingly connected to a drive shaft 31 crossing the frame 3 and passing through openings 32 in the lower eccentrics 24 and 25. The outer peripheries of the lower crank discs 18 and 19 have gear teeth thereon as indicated at 33 and 34. The upper crank discs 20 and 21 also have outer peripheral gear teeth 35 and 36 thereon. The upper crank disc gear wheels 20 and 21 are floatingly mounted to the frame 3 in such a manner that they drivingly engage the lower crank disc gear wheels 18 and 19. Both the upper and the lower crank discs 18–21 have openings 38 adjacent the crank pins 22 or 23, and the cam followers 29, 30 extend through those openings. if desired or necessary, the arms 28 on the eccentrics 24–27 can also pass through the openings 38 in the crank disc gear wheels 18–21. In the arrangement shown and described, the cams and the crank pins are located on opposite sides of each crank disc gear wheel.

The cam followers defined by the rollers 30 are positioned in such a manner that both the outer and inner cam surfaces 39 and 40 on the double cams 12–15 act upon the cam followers during the movements of the tools along their paths.

Rings 42, 43, 44 and 45 are suitably movably mounted as on ball bearings 41 around the eccentrics 24, 25, 26 and 27. The lower tool carrier 8 is rigidly secured to the lower rings 42 and 43, while the upper tool carrier 10 is yieldingly secured to the upper rings 44 and 45. This is accomplished by having the upper rings 44 and 45 connected rigidly together by one or more connecting bars 46. Vertical rods suitably secured to the bar 46 and to the rings 44, 45 pass freely in close guiding relationship through suitable holes in the opposite end portions of the upper tool carrier 10. Coil springs surrounding the rods are located between the bar 46 and the upper tool carrier 10 for normally biasing the tool carrier 10 downwardly and also allows the upper tool carrier 10 to yield upwardly somewhat when it engages the lower tool during movement along the linear operating paths.

Guide means in the form of the elongated vertical guide rods 16 are rigidly secured to the upper rings 44 and 45, and pass in close guiding relationship through holes in the eyes 17 on the lower rings 42 and 43. This arrangement guides the movements of the upper and lower tools for maintaining same in their proper relationship to one another.

A cutting blade 47 controlled and operated in a known manner may be associated with the tool 11 for severing the wrapping tube if so desired. The sealing tools and the severing blade may be replaced by welding tools and other severing tools in a known manner.

Figure 3:
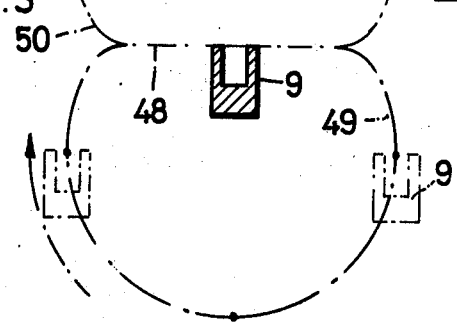
FIG. 3 is a diagrammatic showing of the movement of a sealing tool in the apparatus of FIGS. 1 and 2.

The drive shaft 31 is suitably driven rotatably for directly rotatably driving the crank disc gear wheels 18 and 19, and for indirectly rotatably driving the crank disc gear wheels 20 and 21 due to their engagement with the lower crank disc gear wheels 18 and 19. Rotatably driving the crank disc gear wheels 18–21 causes the crank pins 22 and 23 thereon to move the levers defined by the eccentrics 24–27. The eccentrics move the cam followers 30 along the cam tracks defined by the spaced-apart opposed cam surfaces 39 and 40 of the cams 12–15. As a result of the cooperation between the cams and cam followers, the cam followers defined by the rollers 30 assume different distances outwardly from the drive shaft 31 and axes 37, and this results in pivoting of the arms 28 attached to the eccentrics 24–27. The cam surfaces 39 and 40 are suitably designed so that while the crank disc gear wheels 18–21 and the eccentrics 24–27 are rotating, the effective lengths of the crank mechanisms 4–7 are varied in such a manner that the paths along which the tools and tool carriers travel are as shown in FIG. 3. Each path for a tool 9 or 11 includes a linear operating path 48 having a beginning at the left of FIG. 3 and an end at the right of FIG. 3. Arcuate return paths 49 and 50 are the return paths which the tools follow in returning from the end of the operating path to the beginning thereof. The cams 12–15 are configured such that the path of the upper tool 11 is a mirror image of the path followed by the lower tool 9. The sealing tools 9 and 11, and their carriers 8 and 10, are kept in parallel alignment with one another by the guide means defined by the guide rods 16 and the eyes 17 so that the wrapping tube 51 is transversely sealed without any difficulty. The tools travel along the operating path 48 at the same speed as the wrapping tube 51 for sealing same at spaced intervals. If desired or necessary, the wrapping tube 51 is easily severed by the parting blade 47 as the tools move along the linear operating path.

Figure 2:
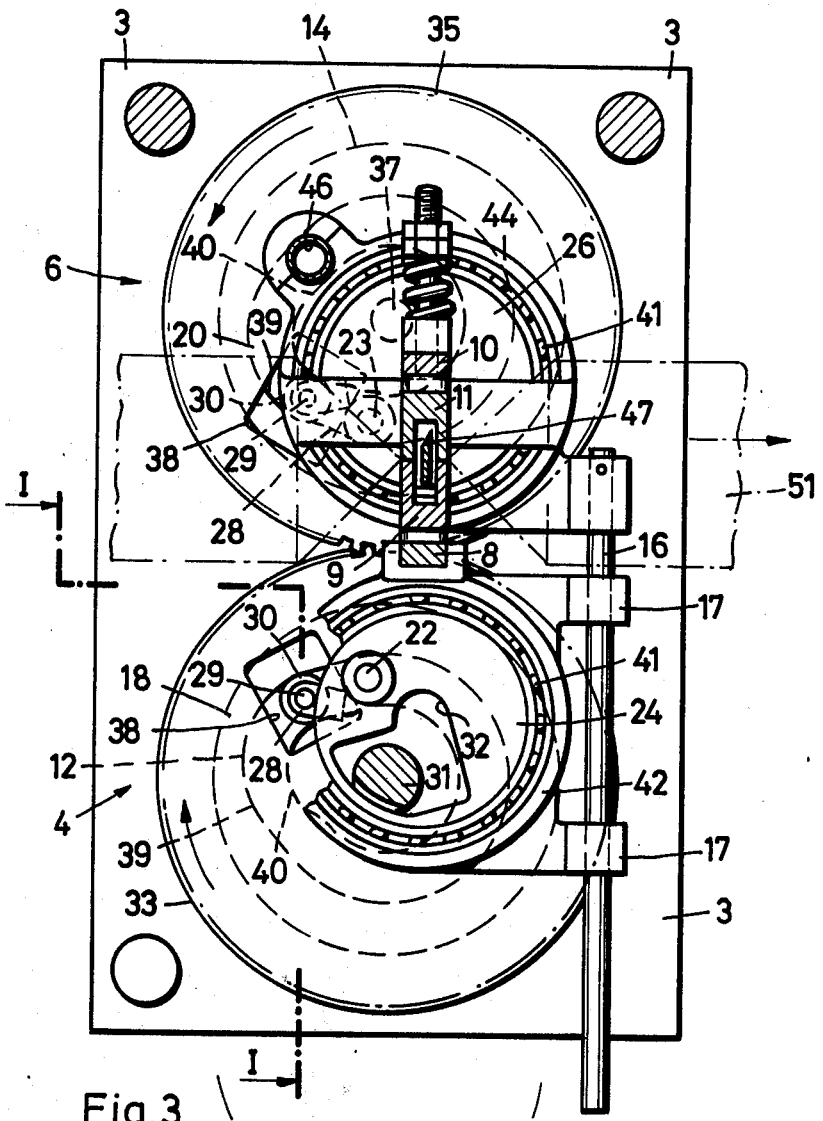
FIG. 2 is a cross-sectional elevational view of the apparatus shown in FIG. 1.

As best shown in FIG. 2 with respect to the lever eccentric 24, the eccentric 24 has a greater mass to the right of the crank pin 22 than to the left thereof where the cam follower 30 is located. In other words, the eccentrics have a greater mass on the opposite sides of the crank pins from the cam followers. The greater masses are also located such that during high speed movement of the crank mechanisms, and especially during movement of the tools and carriers along the return paths 49, 50 of FIG. 3, centrifugal force acting on the eccentric causes them to pivot about the crank pins and urge the cam followers into engagement with the inner cam surfaces 40 located opposite from the outer cam surfaces 39 of the cam tracks. This eliminates the need for heavy springs to bias the cam followers into engagement with a cam surface. The yielding mounting arrangement of the upper tool carrier relative to the upper rings allows the upper tool to move generally perpendicular to the operating path as the tools come together for sealing the tube.

While there has been described what is at present considered to be the preferred embodiment of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. Apparatus for transversely sealing a wrapping tube comprising: opposed sealing tools movable in unison linearly along an operating path having a beginning and an end while sealing a wrapping tube and returning from said end to said beginning by moving along arcuate return paths, crank mechanisms for so moving said tools and including cam tracks and cooperating cam followers, said cam followers being urged against said cam tracks under the influence of centrifugal force during movement of said tools along said return paths; interconnecting guide means for guiding said tools along said paths; and wherein said tools are mounted on carriers and said guide means extends substantially perpendicular to said operating path.

2. The apparatus of claim 1 wherein each said cam track includes spaced-apart opposed inner and outer cam surfaces between which said cam followers are positioned, and said cam followers being urged by centrifugal force against said inner cam surface.

3. The apparatus of claim 1 wherein said guide means includes elongated guide rods fixed to one said carrier and extending in closed guiding relationships through openings in the other said carrier.

4. Apparatus for transversely sealing a wrapping tube comprising: opposing sealing tools movable in unison linearly along an operating path having a beginning and end while sealing a wrapping tube and returning from said end to said beginning by moving along arcuate return paths, crank mechanisms for so moving said tools and including cam tracks and cooperating cam followers, said cam followers being urged against said cam tracks under the influence of centrifugal force during movement of said tools along said return paths; said crank mechanism further comprising crankpins rotating about crankshafts, levers mounted on said crankpins, with said cam followers being secured to said levers and with said levers comprising eccentrics surrounding said crankpins.

5. A crank mechanism for moving a tool linearly along an operating path having a beginning and end and returning same from said end to said beginning along a return path separated from said operating path comprising: a crank disc rotatable about an axis, a fixed cam track surrounding said axis and including opposed inner and outer cam surfaces, a crankpin secured to said crank disc outwardly of said axis; a lever connected with said crankpin and with said tool, a cam follower on said lever received between said cam surfaces for moving said tool along said paths in response to rotation of said crank disc, said cam follower being urged into engagement with said inner cam surface during movement of said tool along said return path under influence of centrifugal force acting on said lever during rotation of said crank disc, and said lever and said cam track being on opposite sides of said crank disc and said crank disc having an opening through which said cam follower extends.

6. A crank mechanism for moving a tool linearly along an operating path having a beginning and end and returning same from said end to said beginning along a return path separate from said operating path comprising: a crank disc rotatable about an axis, a fixed cam track surrounding said axis and including opposed inner and outer cam surfaces, a crankpin secured to said crank disc outwardly of said axis, a lever connected with said crankpin and with said tool, a cam follower on said lever received between said cam surfaces for moving said tool along said paths in response to rotation of said crank disc, wherein said lever comprises an eccentric having an enlarged opening surrounding said axis about which said crank disc rotates for accommodating a drive shaft connected with said crank disc.

7. Apparatus for transversely sealing a wrapping tube comprising opposed sealing tools movable in unison linearly along an operating path having a beginning and end while sealing a wrapping tube and returning from said end to said beginning by moving along arcuate return paths, crank mechanisms for so moving said tools and including cam tracks and cooperating cam followers, said cam followers being urged against said cam tracks under the influence of centrifugal force during movement of said tools along said return paths; said crank mechanism comprising upper and lower crank mechanism having drivingly engaged upper and lower gear wheel crank discs rotatable about fixed axes, crankpins extending outwardly from one side of said crank discs, levers mounted on said crankpins and carrying said cam followers, said cam tracks comprising stationary can tracks surrounding said axes on the other side of said crank discs from said crankpins, and openings in said crank discs through which said cam followers extend for cooperation with said cam tracks.

8. The apparatus of claim 7 wherein said lower crank mechanism includes a pair of laterally spaced-apart lower crank mechanisms having said crank discs thereof connected by a common drive shaft, and said levers on said lower crank mechanisms having openings therein through which said drive shaft extends.

9. A crank mechanism for moving a tool linearly along an operating path having a beginning and end and returning from said end to said beginning along a return path separate from said operating path comprising: a crank disc rotatable about an axis, a fixed cam track surrounding said axis and including opposed inner and outer cam surfaces, a crankpin secured to said crank disc outwardly of said axis, a lever connected with said crank pin and with said tool, a cam follower on said lever received between said cam surfaces for moving said tool along said paths in response to rotation of said crank disc, and another such tool and mechanism defining said upper and lower cooperating tools and upper and lower mechanisms, tool carriers connected with said levers and guide means between said carriers for guiding said carriers for movement in unison along said paths.

10. The crank mechanism of claim 9 wherein said guide means includes at least one elongated guide rod connected to one of said carriers and extending in closely guided relationship through a hole in the other said carrier.

11. The crank mechanism of claim 9 wherein said upper tool is mounted for limited movement relative to said levers on said upper mechanism in a direction generally perpendicular to said operating path, and yieldable biasing means for normally biasing said upper tool toward said operating path.

* * * * *